US008781344B2

(12) United States Patent
Takada

(10) Patent No.: US 8,781,344 B2
(45) Date of Patent: Jul. 15, 2014

(54) IMAGE FORMING APPARATUS, IMAGE FORMING METHOD, AND FIXING APPARATUS

(75) Inventor: Setsuo Takada, Shizuoka-ken (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 214 days.

(21) Appl. No.: 13/525,463

(22) Filed: Jun. 18, 2012

(65) Prior Publication Data

US 2012/0328308 A1 Dec. 27, 2012

Related U.S. Application Data

(60) Provisional application No. 61/500,324, filed on Jun. 23, 2011.

(51) Int. Cl.
*G03G 15/20* (2006.01)

(52) U.S. Cl.
USPC ..... 399/33; 399/69

(58) Field of Classification Search
USPC ..... 399/328, 331, 332, 330, 33, 69
See application file for complete search history.

(56) References Cited

U.S. PATENT DOCUMENTS

| | | | | |
|---|---|---|---|---|
| 5,436,711 | A * | 7/1995 | Hauser | 399/328 |
| 6,047,158 | A * | 4/2000 | Morigami et al. | 399/328 |
| 8,041,245 | B2 * | 10/2011 | Barton et al. | 399/69 |
| 2008/0118262 | A1 * | 5/2008 | Kinouchi et al. | 399/69 |
| 2008/0118264 | A1 * | 5/2008 | Mori et al. | 399/69 |
| 2010/0034548 | A1 | 2/2010 | Naitoh et al. | |
| 2010/0266307 | A1 * | 10/2010 | Kagawa | |

* cited by examiner

*Primary Examiner* — Susan Lee
(74) *Attorney, Agent, or Firm* — Amin, Turocy & Watson, LLP

(57) ABSTRACT

According to one embodiment, an image forming apparatus includes an image forming section configured to form a toner image on a medium, a fixing device including a heating member configured to heat the medium and a pressurizing member configured to come into contact with the heating member via the medium and heat the medium, and a control section configured to stop, if the temperatures of the heating member and the pressurizing member deviate from a predetermined temperature range, the image forming operation, separate the heating member and the pressurizing member, and control the respective temperatures within the predetermined temperature range.

19 Claims, 7 Drawing Sheets

| | Resumption temperature after lower limit abnormality | Resumption temperature after upper limit abnormality |
|---|---|---|
| Fixing roller temperature | $Th > \alpha 1$ | $Th < \alpha 2$ |
| Pressurizing roller temperature | $Tp > \beta 1$ | $Tp < \beta 2$ |
| Condition | $\alpha 1 > \beta 1$<br>$\alpha 1 - \beta 1 < \Delta T$ | $\alpha 2 < \beta 2$<br>$\beta 2 - \alpha 2 < \Delta T$ |

F I G. 8

IMAGE FORMING APPARATUS, IMAGE FORMING METHOD, AND FIXING APPARATUS

CROSS-REFERENCE TO RELATED APPLICATIONS

This application is based upon and claims the benefit of U.S. Provisional Application No. 61/500,324, filed on Jun. 23, 2011; the entire contents of which are incorporated herein by reference.

FIELD

Embodiments described herein relate generally to an image forming apparatus, an image forming method, and a fixing apparatus.

BACKGROUND

A quadruple tandem image forming apparatus in the past operates according to a procedure explained below. The image forming apparatus forms toner images respectively on the surfaces of photoconductive members for Y, M, C, and BK and transfers the toner images on the photoconductive members onto an intermediate transfer member. The intermediate transfer member transfers the toner images onto a medium. The medium having the toner images transferred thereon passes through a fixing apparatus. The fixing apparatus heats both the surfaces of the medium while pressurizing the surfaces to fix the toner images on the medium. The medium passed through the fixing apparatus is discharged to a paper discharge tray.

Incidentally, the fixing apparatus is deprived of heat by coming into contact with the medium. Therefore, temperature control is performed to keep the temperature of the fixing apparatus at a predetermined temperature. If abnormality occurs in which fixing temperature during printing deviates from a normal temperature range, a printing operation is suspended and temperature control for returning the fixing temperature to normal fixing temperature is performed. The printing operation is resumed when the fixing temperature returns to the normal temperature range.

BRIEF DESCRIPTION OF THE DRAWINGS

FIG. 8 is an exemplary diagram for explaining conditions of resumption temperatures in a fixing apparatus according to a second embodiment.

DETAILED DESCRIPTION

In general, according to one embodiment, an image forming apparatus includes: an image forming section configured to form a toner image on the front surface of a medium; a fixing device including a heating member configured to heat the front surface of the medium and a pressurizing member configured to come into contact with the heating member via the medium and heat the rear surface of the medium; and a control section configured to stop, if the temperatures of the heating member and the pressurizing member deviate from a predetermined temperature range during an image forming operation of the image forming section, the image forming operation of the image forming section, separate the heating member and the pressurizing member, and control the respective temperatures of the heating member and the pressurizing member to temperatures within the predetermined temperature range.

First Embodiment

Figure 1:
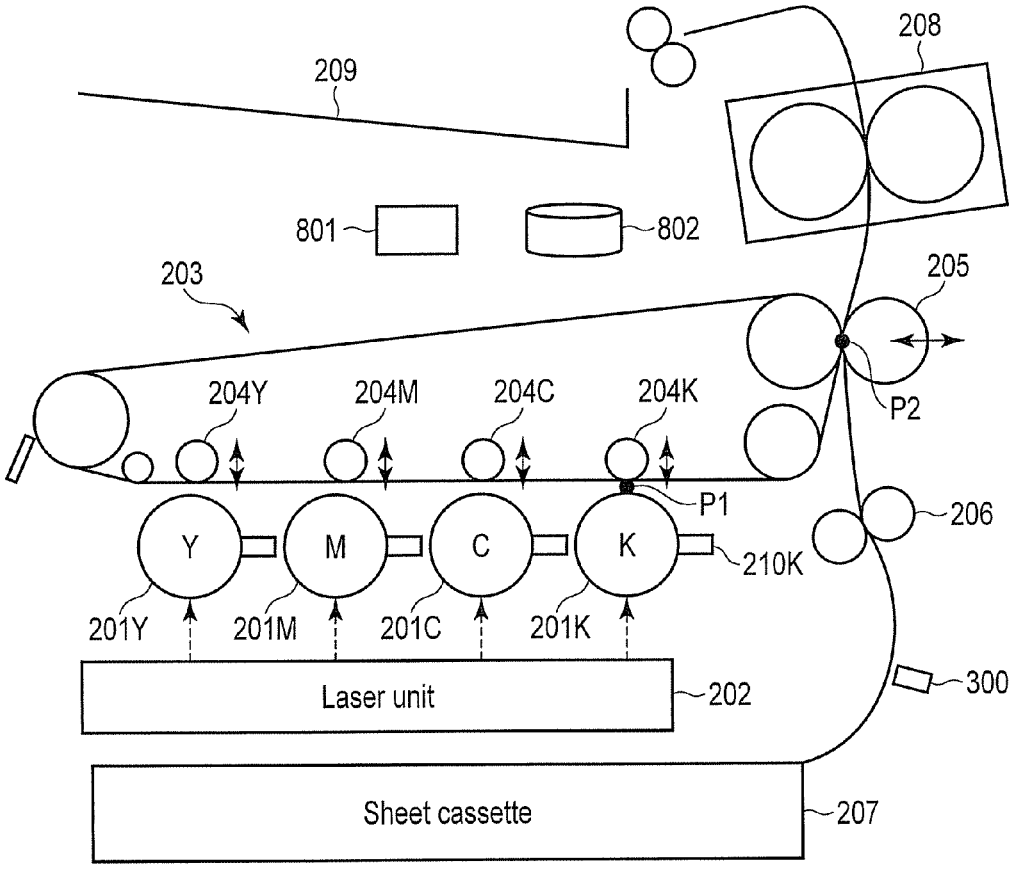
FIG. 1 is an exemplary overall configuration diagram of an image forming apparatus according to a first embodiment.

FIG. 1 is an exemplary overall diagram of an image forming apparatus according to a first embodiment. The image forming apparatus shown in FIG. 1 is an electrophotographic recording apparatus by a quadruple tandem process.

The image forming apparatus includes photoconductive members 201Y to 201K, a laser unit 202, a transfer belt 203, primary transfer rollers 204Y to 204K, a secondary transfer roller 205, a registration roller 206, a sheet cassette 207, a fixing apparatus 208, a paper discharge tray 209, a CPU 801, a memory 802, and a media sensor 300.

The CPU 801 collectively controls various kinds of processing in the image forming apparatus. The CPU 801 executes computer programs stored in the memory 802 to thereby realize various functions of the image forming apparatus. The memory 802 includes a ROM and a RAM and stores various kinds of information such as programs used in the image forming apparatus besides the computer programs.

An image forming operation in the image forming apparatus is explained. An operation concerning the photoconductive member 201K is explained. However, an operation concerning the other photoconductive members 201Y to 201C is the same.

When image forming processing is started, a photoconductive surface of the photoconductive member 201K is cleaned according to the rotation of the photoconductive member 201K. Subsequently, after the photoconductive surface of the photoconductive member 201K is subjected to charge removal processing, charging processing is applied to the photoconductive surface. The laser unit 202 applies, on the basis of image data, exposure processing to an area of the photoconductive surface of the photoconductive member 201K subjected to the charging processing and forms an electrostatic latent image on the photoconductive surface. The electrostatic latent image is visualized with a two-component developer including a toner and a carrier.

The transfer belt 203 comes into contact with and separates from the photoconductive member 201K according to the movement of the primary transfer roller 204K. A toner image visualized on the photoconductive member 201K is transferred from the photoconductive surface onto a belt surface of the transfer belt 203 in a predetermined transfer position P1 when the transfer belt 203 comes into contact with the photoconductive member 201K. Similarly, toner images of the respective colors are transferred onto the transfer belt 203.

The secondary transfer roller 205 is arranged to be capable of coming into contact with and separating from the belt surface of the transfer belt 203. A medium conveyed from the sheet cassette 207 is pressed against the belt surface in a predetermined secondary transfer position P2 by the secondary transfer roller 205. The toner images are transferred onto the medium.

The media sensor 300 detects characteristics of paper. The characteristics of the paper are paper thickness, paper basis weight, and the like. The fixing apparatus 208 heats and fixes, according to the detected paper thickness, the toner images transferred onto the medium. The medium is then discharged to the paper discharge tray 209.

Figure 2:
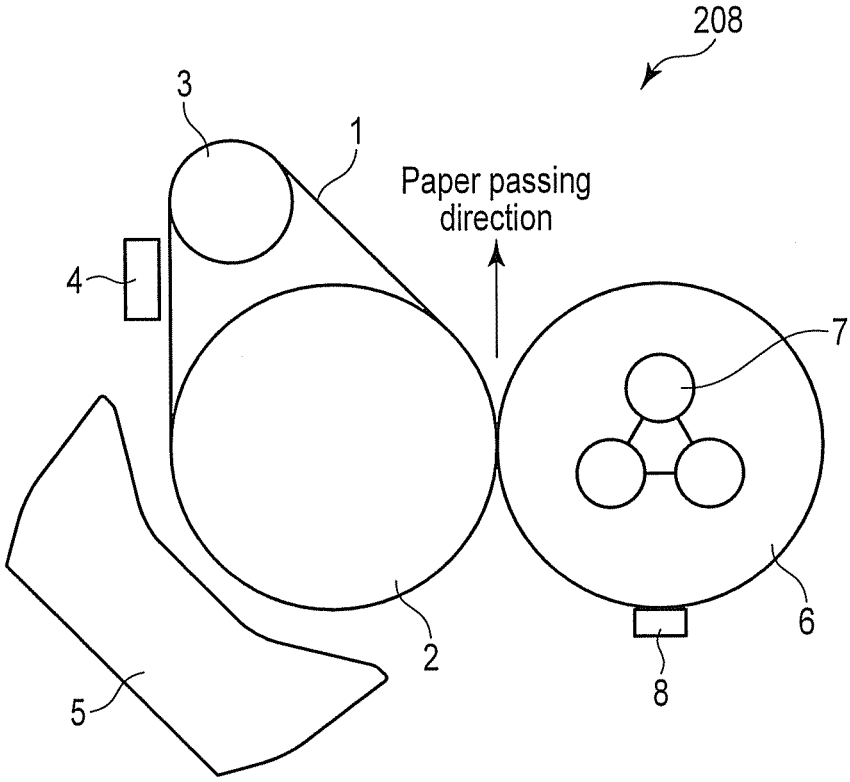
FIG. 2 is an exemplary schematic diagram of the configuration of a fixing apparatus according to the first embodiment.

FIG. 2 is an exemplary schematic diagram of the configuration of the fixing apparatus 208 according to the first embodiment.

The fixing apparatus 208 includes a fixing roller 2 and a pressurizing roller 6 for heating and pressurizing a medium to which a toner adheres. A fixing belt 1 is stretched around the fixing roller 2 and a tension roller 3. The fixing belt 1 forms an endless track according to the rotation of the rollers 2 and 3. An IH coil unit 5 heats the fixing belt 1 with induction heating (IH). A temperature sensor 4 measures the temperature of the fixing belt 1.

The pressurizing roller 6 is provided to be opposed to the fixing roller 2. Heating sources 7 such as lamps are provided on the inside of the pressurizing roller 6. In FIG. 2, three heating sources 7 are shown. A temperature sensor 8 measures surface temperature of the pressurizing roller 6.

In this embodiment, a heating member is the fixing belt 1. In a fixing apparatus of another embodiment, a fixing belt is not provided. A heating roller includes heat generation sources. In this configuration, the heating roller is the heating member. In this embodiment, a pressurizing member is the pressurizing roller 6. In the fixing apparatus of the other embodiment, instead of a pressurizing roller, a pressurizing belt pressurizes a medium. In this configuration, the pressurizing belt is the pressurizing member.

The operation of the fixing apparatus 208 is explained.

The IH coil unit 5 heats the fixing belt 1 with electromagnetic induction heating. The fixing belt 1 is driven by the rotation of the fixing roller 2 and the tension roller 3. The fixing roller 2 presses the fixing belt 1 against the pressurizing roller 6 with a spring or the like. On the other hand, the inside of the pressurizing roller 6 is also heated by the heating sources 7. Therefore, an area where a medium is heated called nip is formed in an area where the fixing belt 1 and the pressurizing roller 6 are in contact with each other. The medium passes through the nip in a paper passing direction, whereby a toner image formed on the medium is melted and fixed.

Figure 3:
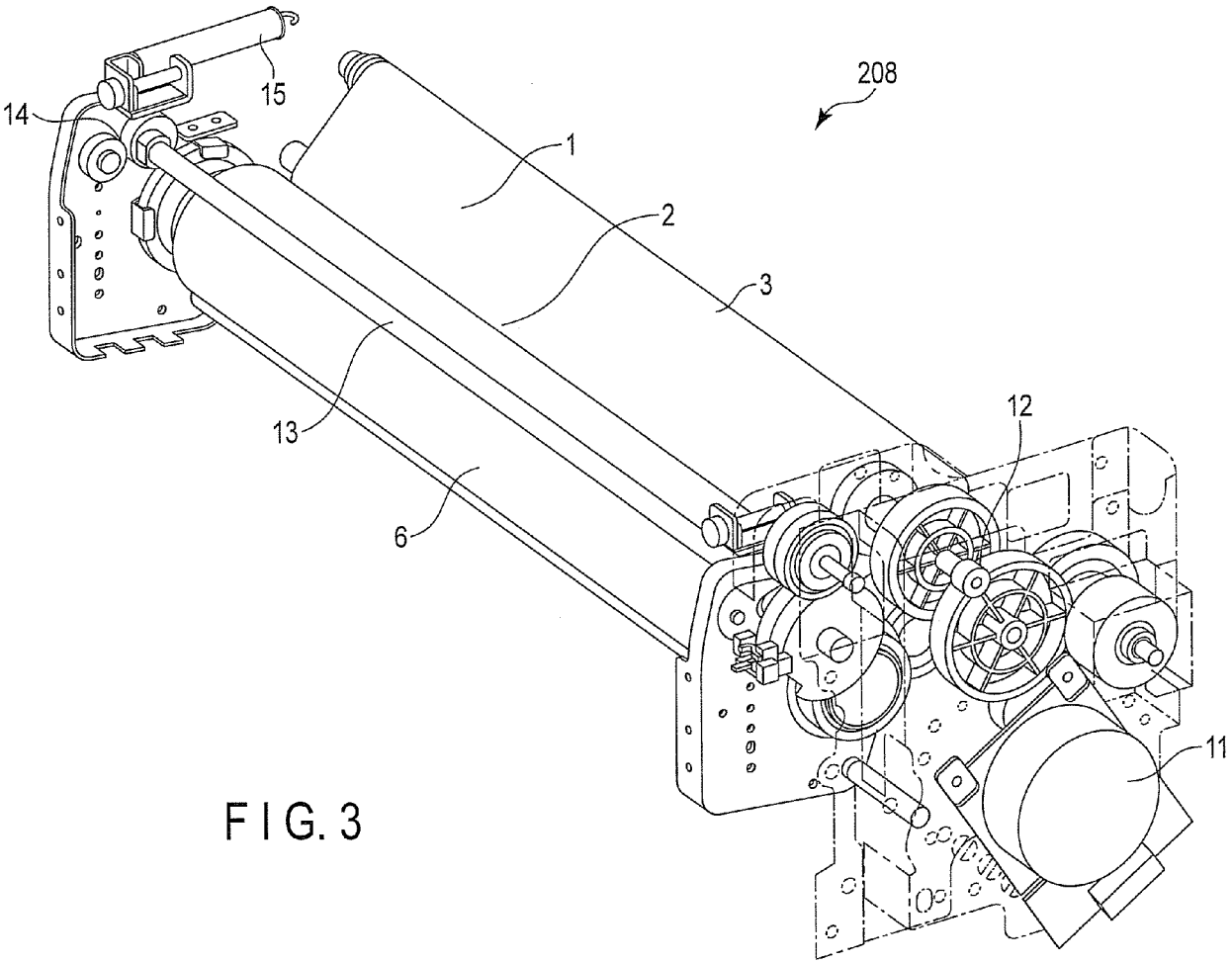
FIG. 3 is an exemplary perspective view of the overall configuration of the fixing apparatus according to the first embodiment.

FIG. 3 is an exemplary perspective view of the overall configuration of the fixing apparatus 208 according to the first embodiment.

The pressurizing roller 6 and the fixing roller 2 are configured to be capable of coming into contact with and separating from each other. Specifically, a pressurizing spring 15 is connected between a frame (not shown in the figure) that holds the pressurizing roller 6 and another frame that holds the fixing roller 2. On the other hand, a separating cam 14 is provided between the frame that holds the pressurizing roller 6 and the other frame that holds the fixing roller 2. Therefore, according to the rotation of the separating cam 14, a distance between the pressurizing roller 6 and the fixing roller 2 continuously changes. When the pressurizing roller 6 and the fixing roller 2 come into contact with each other, a pressurizing force by the pressurizing spring 15 is applied to the pressurizing roller 6 and the fixing roller 2.

On the other hand, a driving motor 11 rotates a shaft 13, which is a separating mechanism, via a driving gear group 12. The shaft 13, which is the separating mechanism, is connected to a rotating shaft of the separating cam 14. Therefore, it is possible to control contact and separating operations and the pressurizing force of the pressurizing roller 6 and the fixing roller 2 by driving the driving motor 11.

Figure 4:
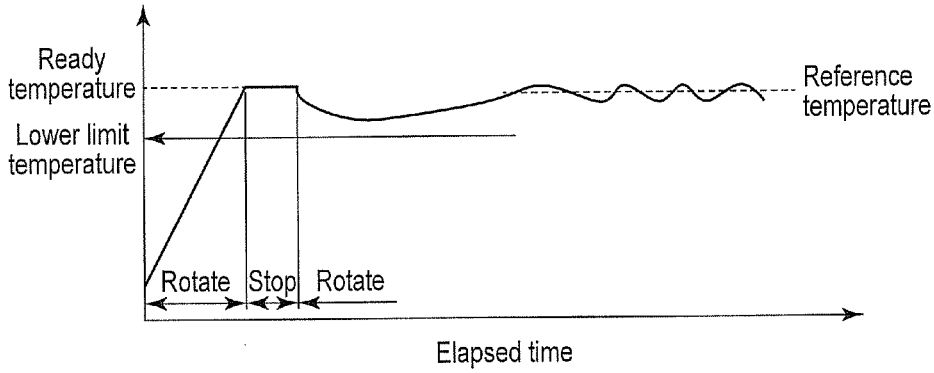
FIG. 4 is an exemplary time chart of a temperature control state at normal time of the fixing apparatus according to the first embodiment.

FIG. 4 is an exemplary time chart of a temperature control state at normal time of the fixing apparatus 208 according to the first embodiment. The ordinate of the coordinate axes represents the temperatures of the fixing roller 2 and the pressurizing roller 6 and the abscissa represents time.

In the following explanation, for convenience, the operation of a form in which a fixing belt is not used and the fixing roller 2 and the pressurizing roller 6 are in direct contact with each other is explained.

When a power supply for the image forming apparatus is turned on, warm-up is started. Maximum power is applied to the fixing roller 2 and the pressurizing roller 6. The respective temperatures of the fixing roller 2 and the pressurizing roller 6 rise. While the temperatures rise, the fixing roller 2 and the pressurizing roller 6 rotate in a contact state.

The image forming apparatus changes to a ready state when the respective temperatures reach a predetermined value. The respective temperatures are controlled to the predetermined value (a ready temperature). In the ready state, the fixing roller 2 and the pressurizing roller 6 stop in the contact state.

When a printing operation is started, the fixing roller 2 and the pressurizing roller 6 start rotation in the contact state. Since the fixing roller 2 and the pressurizing roller 6 are deprived of heat by a medium that comes into contact with the rollers, the temperatures of the fixing roller 2 and the pressurizing roller 6 drop. Therefore, the fixing roller 2 and the pressurizing roller 6 are heated in order to raise the temperatures to a target reference temperature. However, since there is heat removal to the medium, the tendency of the drop of the temperatures continues. At a point when several media pass, the temperature drop to a lowest temperature. The temperatures of the fixing roller 2 and the pressurizing roller 6 are not lower than a lower limit temperature.

Thereafter, the temperatures of the fixing roller 2 and the pressurizing roller 6 rise. After reaching the target reference temperature, the temperatures of the fixing roller 2 and the pressurizing roller 6 are controlled to maintain the reference temperature.

Figure 5:
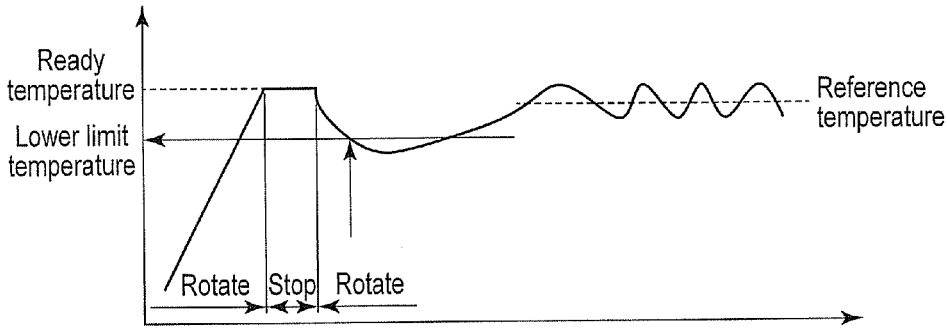
FIG. 5 is an exemplary time chart of a temperature control state at abnormal time of a fixing apparatus in the past.

FIG. 5 is an exemplary time chart of a temperature control state at abnormal time of the fixing apparatus 208 in the past.

When the power supply for the image forming apparatus is turned on, warm-up is started. Maximum power is applied to the fixing roller 2 and the pressurizing roller 6. The respective temperatures of the fixing roller 2 and the pressurizing roller 6 rise. While the temperatures rise, the fixing roller 2 and the pressurizing roller 6 rotate in a contact state.

The image forming apparatus changes to the ready state when the respective temperatures reach the predetermined value. The respective temperatures are controlled to the predetermined value (the ready temperature). In the ready state, the fixing roller 2 and the pressurizing roller 6 stop in the contact state.

When a printing operation is started, the fixing roller 2 and the pressurizing roller 6 start rotation in the contact state. Since the fixing roller 2 and the pressurizing roller 6 are deprived of heat by a medium that comes into contact with the rollers, the temperatures of the fixing roller 2 and the pressurizing roller 6 drop. Therefore, the fixing roller 2 and the pressurizing roller 6 are heated in order to raise the temperatures to the target reference temperature. However, since there is heat removal to the medium, the tendency of the drop of the temperatures continues.

In a case shown in FIG. 5, the temperature of the fixing roller 2 or the pressurizing roller 6 is equal to or lower than the lower limit temperature because of a low power supply voltage environment, a low temperature environment or the like. The lower limit temperature is also called low temperature wait threshold temperature and is temperature for suspending the printing operation (low temperature wait) before the temperature of the fixing roller 2 or the pressurizing roller 6 drops to temperature at which a fixing failure occurs.

In a low temperature wait state, the fixing roller 2 and the pressurizing roller 6 rotate in the contact state. In the low temperature wait state, since the fixing roller 2 and the pressurizing roller 6 are not deprived of heat by a medium, the temperatures of the rollers rise. After the temperatures of the fixing roller 2 and the pressurizing roller 6 reach a resumption fixing temperature higher than the target reference temperature, the printing is resumed. Thereafter, the temperatures of the fixing roller 2 and the pressurizing roller 6 are controlled to maintain the reference temperature.

When the temperatures of the fixing roller 2 and the pressurizing roller 6 rise to be equal to or higher than an upper limit temperature (a high temperature wait threshold temperature), the heating sources 7 changes to a stop state. The fixing roller 2 and the pressurizing roller 6 rotate in the contact state. After the temperatures of the fixing roller 2 and the pressurizing roller 6 reach a resumption fixing temperature lower than the target reference temperature, the printing is resumed. Thereafter, the temperatures of the fixing roller 2 and the pressurizing roller 6 are controlled to maintain the reference temperature.

As explained above, when the temperatures are abnormal, the printing is suspended. Therefore, the user is kept waiting until the printing is resumed. Therefore, there is a need for a technology that can reduce time from the suspension of the printing to the resumption of the print.

Figure 6:
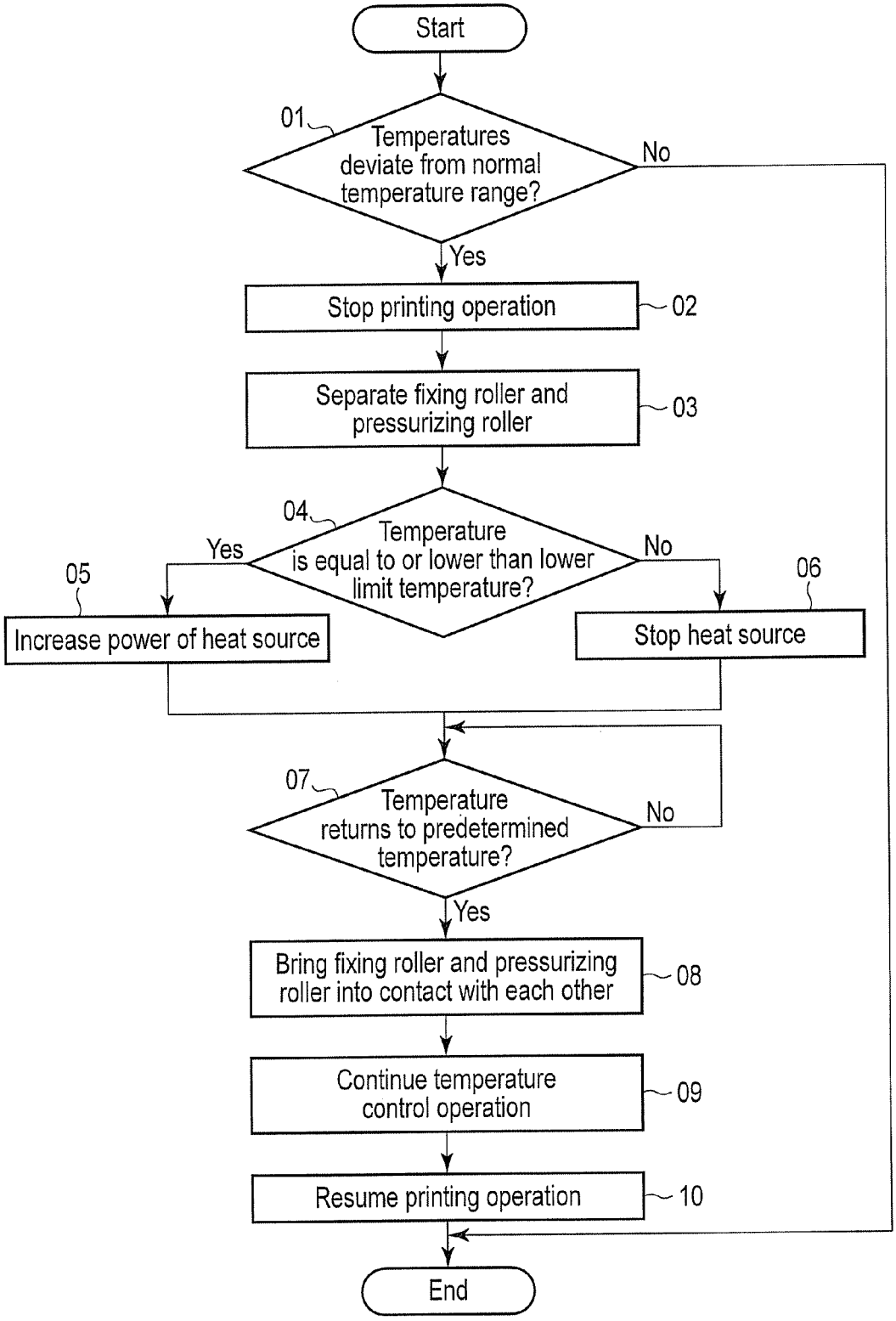
FIG. 6 is an exemplary flowchart for explaining a temperature control procedure of the fixing apparatus according to the first embodiment.

FIG. 6 is an exemplary flowchart for explaining a temperature control procedure of the fixing apparatus 208 according to the first embodiment.

In Act 01, the CPU 801 determines whether the temperatures of the fixing roller 2 and the pressurizing roller 6 deviate from a normal temperature range. If the temperatures are within a normal temperature range (NO in Act 01), the CPU 801 ends the processing. In other words, the CPU 801 executes normal temperature control processing without suspending the printing operation.

If the temperature is outside the normal temperature range (YES in Act 01), in Act 02, the CPU 801 suspends the printing operation. In Act 03, the CPU 801 separates the fixing roller 2 and the pressurizing roller 6 while continuing the rotation of the fixing roller 2 and the pressurizing roller 6.

In Act 04, the CPU 801 determines whether the temperatures of the fixing roller 2 and the pressurizing roller 6 are equal to or lower than the lower limit temperature. If the temperatures are equal to or lower than the lower limit temperature (YES in Act 04), in Act 05, the CPU 801 increases the power of a heat source for the fixing roller 2 and the pressurizing roller 6 to a maximum and raises the temperatures. If the temperatures are equal to or higher than the upper limit temperature (NO in Act 04), in Act 06, the CPU 801 stops the power of the heat source for the fixing roller 2 and the pressurizing roller 6.

In Act 07, the CPU 801 stays on standby until the temperature of the fixing roller 2 returns to a predetermined temperature. The predetermined temperature is temperature higher than the reference temperature if abnormal temperature is equal to or lower than the lower limit temperature and is temperature lower than the reference temperature if abnormal temperature is equal to or higher than the upper limit temperature. If the temperature of the fixing roller 2 returns to the predetermined temperature (YES in Act 07), in Act 08, the CPU 801 brings the fixing roller 2 and the pressurizing roller 6 into contact with each other and continues the rotation.

The predetermined temperature different from the reference temperature is provided in order to prevent temperature control from being disordered by a temperature change due to the contact of the fixing roller 2 and the pressurizing roller 6 because only the temperature of the fixing roller 2 is the target of the determination whether the temperature returns to the predetermined temperature in Act 7 and the temperature of the separated pressurizing roller 6 is unknown.

In Act 09, the CPU 801 continues the temperature control operation. In Act 10, the CPU 801 resumes the printing operation.

As explained above, in the first embodiment, if abnormal temperature deviating from the normal temperature range occurs, the CPU 801 separates the fixing roller 2 and the pressurizing roller 6. The CPU 801 returns the temperature of the fixing roller 2 to the target reference temperature and, thereafter, brings the fixing roller 2 and the pressurizing roller 6 into contact with each other and resumes the printing. Consequently, compared with the system for not separating the fixing roller 2 and the pressurizing roller 6 in the past, it is possible to further reduce a waiting time and resume the printing more quickly.

A reason for this as explained below.

In general, the heat capacity of the pressurizing roller 6 is larger than the heat capacity of the fixing roller 2. Therefore, if the fixing roller 2 and the pressurizing roller 6 are in contact with each other, even if the fixing roller 2 is heated, the heat of the fixing roller 2 is deprived by the pressurizing roller 6. As a result, temperature rising speed of the fixing roller 2 decreases. Since the fixing roller 2 comes into direct contact with a toner surface of the medium, the fixing roller 2 is considered to be predominant concerning the fixing over the pressurizing roller 6.

Therefore, if an abnormal temperature drop is detected, the CPU 801 separates the fixing roller 2 and the pressurizing roller 6 and raises the temperature of the fixing roller 2 in time shorter than temperature rise time of the pressurizing roller 6. When the temperature of the fixing roller 2 reaches a target resumption temperature, the CPU 801 brings the fixing roller 2 and the pressurizing roller 6 into contact with each other and resumes the printing operation.

In the example explained above, a fixing temperature drops to abnormally low temperature. However, the present invention can be applied in the same manner if the fixing temperature rises to abnormally high temperature. This is because, if the fixing roller 2 and the pressurizing roller 6 are in contact with each other, temperature drop speed of the fixing roller 2 decreases because of heat accumulated in the pressurizing roller 6.

Therefore, if an abnormal temperature rise is detected, the CPU 801 separates the fixing roller 2 and the pressurizing roller 6 and lowers the temperature of the fixing roller 2 in time shorter than temperature drop time of the pressurizing roller 6. When the temperature of the fixing roller 2 reaches the target resumption temperature, the CPU 801 brings the fixing roller 2 and the pressurizing roller 6 into contact with each other and resumes the printing operation.

A form of separation of the fixing roller 2 and the pressurizing roller 6 is explained as follows.

Figure 7A:
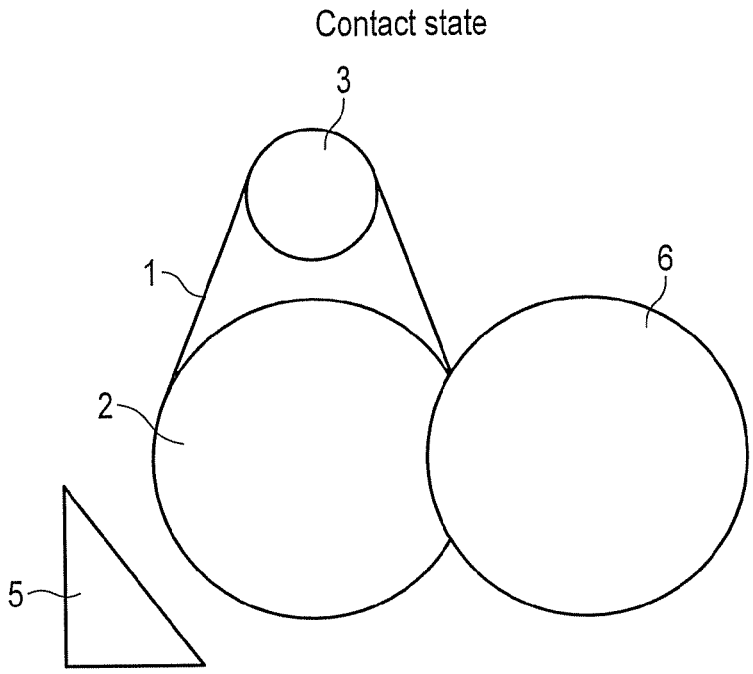
FIG. 7A is an exemplary diagram for explaining a form of contact of a fixing roller and a pressurizing roller in the fixing apparatus according to the first embodiment.
Figure 7B:
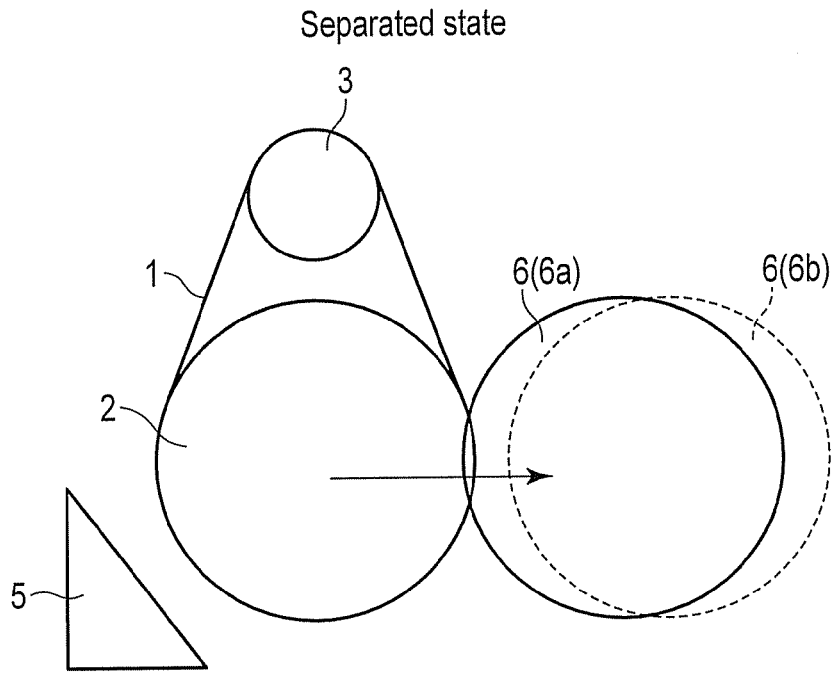
FIG. 7B is an exemplary diagram for explaining a form of separation of the fixing roller and the pressurizing roller in the fixing apparatus according to the first embodiment.

FIGS. 7A and 7B are exemplary diagrams for explaining a form of separation of the fixing roller 2 and the pressurizing roller 6 in the fixing apparatus 208 according to the first embodiment.

A state in which the fixing roller 2 and the pressurizing roller 6 are in contact with each other is shown in FIG. 7A. A state in which the fixing roller 2 and the pressurizing roller 6 are separated from each other is shown in FIG. 7B. The separated state is not limited to a state in which the fixing roller 2 and the pressurizing roller 6 are not in contact with each other as indicated by a pressurizing roller 6*b* represented by a dotted line. The separated state also includes a state in which the fixing roller 2 and the pressurizing roller 6 are in contact with each other with a nip load thereof reduced as indicated by a pressurizing roller 6*a* represented by a solid line.

Since the nip load is reduced, heat conduction between the fixing roller 2 and the pressurizing roller 6 decreases. Therefore, it is possible to reduce the influence of the heat of the pressure roller 6 on the fixing roller 2. When the fixing roller 2 and the pressurizing roller 6 are in contact with each other after the temperatures thereof reach resumption temperatures, it is possible to reduce a sudden change in a roll temperature.

Second Embodiment

A second embodiment is different from the first embodiment in a method of determining whether temperatures reach resumption temperatures. Components same as those in the first embodiment are denoted by the same reference numerals and signs and detailed explanation of the components is omitted.

A temperature control procedure of the fixing apparatus 208 according to a second embodiment is the same as the temperature control procedure of the fixing apparatus 208 according to the first embodiment shown in FIG. 6. However, an action in Act 07 is different as explained below.

In Act 07, the CPU 801 stays on standby until the respective temperatures of the fixing roller 2 and the pressurizing roller 6 return to a predetermined temperature. The predetermined temperature is temperature higher than the reference temperature if abnormal temperature is equal to or lower than the lower limit temperature and is temperature lower than the reference temperature if abnormal temperature is equal to or higher than the upper limit temperature. If the temperatures of the fixing roller 2 and the pressurizing roller 6 return to predetermined temperatures (YES in Act 07), in Act 08, the CPU 801 brings the fixing roller 2 and the pressurizing roller 6 into contact with each other and continues the rotation.

FIG. 8 is an exemplary diagram for explaining conditions of resumption temperatures in the fixing apparatus 208 according to the second embodiment.

After the temperatures of the fixing roller 2 and the pressurizing roller 6 drop to temperatures equal to lower than the lower limit and the printing is suspended, conditions for resumption of the printing are that a fixing roller temperature Th is higher than temperature $\alpha$1 and a pressurizing roller temperature Tp is higher than temperature $\beta$1. The temperature $\alpha$1 may be set higher than the temperature $\beta$1. This is because it is desirable that, when the fixing roller temperature Th reaches a resumption temperature, the pressurizing roller temperature Tp also reaches the resumption temperature. A difference between the resumption temperature $\alpha$1 of the fixing roller 2 and the resumption temperature $\beta$1 of the pressurizing roller 6 may be set to be equal to or smaller than a predetermined value $\Delta T$. This is a condition for preventing a roll temperature from suddenly changing during the contact after the temperatures of the fixing roller 2 and the pressurizing roller 6 reach the resumption temperatures.

After the temperatures of the fixing roller 2 and the pressurizing roller 6 rise to temperatures equal to or higher than the upper limit and the printing is suspended, conditions for resumption of the printing are that the fixing roller temperature Th is lower than temperature $\alpha$2 and the pressurizing roller temperature Tp is lower than temperature $\beta$2. The temperature $\alpha$2 may be set lower than the temperature $\beta$2. This is because it is desirable that, when the fixing roller temperature Th reaches the resumption temperature, the pressurizing roller temperature Tp also reaches the resumption temperature. A difference between the resumption temperature $\alpha$2 of the fixing roller 2 and the resumption temperature $\beta$2 of the pressurizing roller 6 may be set to be equal to or smaller than the predetermined value $\Delta T$. This is a condition for preventing a roll temperature from suddenly changing during the contact after the temperatures of the fixing roller 2 and the pressurizing roller 6 reach the resumption temperatures.

The configuration of the first embodiment and the configuration of the second embodiment can be combined as appropriate.

The functions explained in the embodiments may be configured using hardware or may be realized by causing a computer to read computer programs describing the functions using software. The functions may be configured by selecting the software or the hardware as appropriate.

Further, the functions can also be realized by causing the computer to read computer programs stored in a not-shown recording medium. A recording format of the recording medium in the embodiment may be any form as long as the recording medium is a recording medium that can record the computer programs and can be read by the computer.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. An image forming apparatus comprising:

an image forming section configured to form a toner image on a front surface of a medium;

a fixing device including a heating member configured to heat the front surface of the medium and a pressurizing member configured to come into contact with the heating member via the medium and heat a rear surface of the medium; and a control section configured to stop, if temperatures of the heating member and the pressurizing member deviate from a predetermined temperature range during an image forming operation of the image forming section, the image forming operation of the image forming section, separate the heating member and the pressurizing member, and control the respective temperatures of the heating member and the pressurizing member to temperatures within the predetermined temperature range.

2. The apparatus according to claim 1, wherein the control section brings the heating member and the pressurizing member into contact with each other and resumes the image forming operation of the image forming section when the temperature of the heating member reaches a predetermined temperature.

3. The apparatus according to claim 2, wherein the control section controls the temperatures of the heating member and the pressurizing member to a reference temperature after the resumption of the image forming operation of the image forming section, if temperature at the time when the image forming section is stopped is lower than the predetermined temperature range, the predetermined temperature is higher than the reference temperature, and if the temperature at the time when the image forming section is stopped is higher than the predetermined temperature range, the predetermined temperature is lower than the reference temperature.

4. The apparatus according to claim 1, wherein the separation is a state in which a nip load of the heating member and the pressurizing member is reduced from the nip load during the contact.

5. The apparatus according to claim 4, wherein the control section brings the heating member and the pressurizing member into contact with each other and, when the temperature of the heating member reaches a predetermined temperature, resumes the image forming operation of the image forming section.

6. The apparatus according to claim 5, wherein the control section controls the temperatures of the heating member and the pressurizing member to a reference temperature after the resumption of the image forming operation of the image forming section, if temperature at the time when the image forming section is stopped is lower than the predetermined temperature range, the predetermined temperature is higher than the reference temperature, and if the temperature at the time when the image forming section is stopped is higher than the predetermined temperature range, the predetermined temperature is lower than the reference temperature.

7. The apparatus according to claim 1, wherein the control section brings the heating member and the pressurizing member into contact with each other and resumes the image forming operation of the image forming section when the temperature of the heating member reaches a first predetermined temperature and the temperature of the pressurizing member reaches a second predetermined temperature.

8. The apparatus according to claim 7, wherein the control section controls the temperatures of the heating member and the pressurizing member to a reference temperature after the resumption of the image forming operation of the image forming section, if temperature at the time when the image forming section is stopped is lower than the predetermined temperature range, the first and second predetermined temperatures are higher than the reference temperature, and if the temperature at the time when the image forming section is stopped is higher than the predetermined temperature range, the first and second predetermined temperatures are lower than the reference temperature.

9. The apparatus according to claim 8, wherein if the temperature at the time when the image forming section is stopped is lower than the predetermined temperature range, the first predetermined temperature is higher than the second predetermined temperature, and if the temperature at the time when the image forming section is stopped is higher than the predetermined temperature range, the first predetermined temperature is lower than the second predetermined temperature.

10. The apparatus according to claim 4, wherein the control section brings the heating member and the pressurizing member into contact with each other and resumes the image forming operation of the image forming section when the temperature of the heating member reaches a first predetermined temperature and the temperature of the pressurizing member reaches a second predetermined temperature.

11. The apparatus according to claim 10, wherein the control section controls the temperatures of the heating member and the pressurizing member to a reference temperature after the resumption of the image forming operation of the image forming section, if temperature at the time when the image forming section is stopped is lower than the predetermined temperature range, the first and second predetermined temperatures are higher than the reference temperature, and if the temperature at the time when the image forming section is stopped is higher than the predetermined temperature range, the first and second predetermined temperatures are lower than the reference temperature.

12. The apparatus according to claim 11, wherein if the temperature at the time when the image forming section is stopped is lower than the predetermined temperature range, the first predetermined temperature is higher than the second predetermined temperature, and if the temperature at the time when the image forming section is stopped is higher than the predetermined temperature range, the first predetermined temperature is lower than the second predetermined temperature.

13. An image forming method comprising:

forming a toner image on a front surface of a medium;

heating the front surface of the medium with a heating member;

heating a rear surface of the medium with a pressurizing member that comes into contact with the heating member via the medium; and stopping, if temperatures of the heating member and the pressurizing member deviate from a predetermined temperature range during an operation for forming the toner image, the operation for forming the toner image, separating the heating member and the pressurizing member, and controlling the respective temperatures of the heating member and the pressurizing member to temperatures within the predetermined temperature range.

14. The method according to claim 13, further comprising bringing the heating member and the pressurizing member into contact with each other and resuming the operation for forming the toner image when the temperature of the heating member reaches a predetermined temperature.

15. The method according to claim 13, wherein the separation is a state in which a nip load of the heating member and the pressurizing member is reduced from the nip load during the contact.

16. The method according to claim 13, further comprising bringing the heating member and the pressurizing member into contact with each other and resuming the operation for forming the toner image when the temperature of the heating member reaches a first predetermined temperature and the temperature of the pressurizing member reaches a second predetermined temperature.

17. A fixing apparatus comprising:

a fixing device including a heating member configured to heat a front surface of a medium having a toner image formed thereon and a pressurizing member configured to come into contact with the heating member via the medium and heat a rear surface of the medium; and a control section configured to stop, if temperatures of the heating member and the pressurizing member deviate from a predetermined temperature range during an operation for forming the toner image, the operation for forming the toner image, separate the heating member and the pressurizing member, and control the respective temperatures of the heating member and the pressurizing member to temperatures within the predetermined temperature range.

18. The apparatus according to claim 17, wherein the control section brings the heating member and the pressurizing member into contact with each other and resumes the operation for forming the toner image when the temperature of the heating member reaches a predetermined temperature.

19. The apparatus according to claim 17, wherein the separation is a state in which a nip load of the heating member and the pressurizing member is reduced from the nip load during the contact.

* * * * *